US006138432A

United States Patent [19]

Banicevic

[11] Patent Number: 6,138,432

[45] Date of Patent: Oct. 31, 2000

[54] REFRIGERATOR DOOR CONSTRUCTION

[75] Inventor: Nedo Banicevic, Hamilton, Canada

[73] Assignee: Camco Inc., Canada

[21] Appl. No.: 09/199,785

[22] Filed: Nov. 25, 1998

[30] Foreign Application Priority Data

Oct. 30, 1998 [CA] Canada ..... 2252299

[51] Int. Cl.[7] ..... F25D 11/00; F25D 23/02

[52] U.S. Cl. ..... 52/784.15; 52/784.13; 52/783.19; 52/792.1; 52/794.1; 52/798.1; 52/801.12; 52/309.7; 62/377; 312/405; 312/405.1; 312/408

[58] Field of Search ..... 52/742.11, 783.12, 52/783.13, 783.19, 784.1, 784.11, 784.12, 784.13, 784.15, 792.1, 794.1, 797.1, 798.1, 801.1, 801.11, 801.12, 309.7; 62/377; 312/405, 405.1, 408, 321.5; 49/501

[56] References Cited

U.S. PATENT DOCUMENTS

| | | | |
|---|---|---|---|
| 92,205 | 7/1869 | Mullett et al. . | |
| 1,194,646 | 8/1916 | Linden . | |
| 1,230,567 | 6/1917 | Comee . | |
| 1,630,100 | 5/1927 | Whittier | 52/784.15 X |
| 1,645,692 | 10/1927 | De Penning . | |
| 1,914,646 | 6/1933 | Rand . | |
| 2,413,597 | 12/1946 | Armstrong . | |
| 2,551,369 | 5/1951 | Frohnapel . | |
| 2,612,661 | 10/1952 | Semple . | |
| 2,652,601 | 9/1953 | Slopa et al. . | |
| 2,708,294 | 5/1955 | Saunders . | |
| 2,718,446 | 9/1955 | Hinkel . | |
| 2,725,271 | 11/1955 | Cunningham . | |
| 2,741,808 | 4/1956 | Rasmussen . | |
| 2,764,785 | 10/1956 | Sulcek . | |
| 2,816,331 | 12/1957 | Moore | 52/784.15 X |
| 3,078,003 | 2/1963 | Kesling . | |
| 3,091,946 | 6/1963 | Kesling . | |
| 3,152,199 | 10/1964 | Roberts . | |
| 3,240,029 | 3/1966 | Wurtz . | |
| 3,250,041 | 5/1966 | Anger . | |
| 3,563,845 | 2/1971 | Stevens . | |
| 3,882,637 | 5/1975 | Lindenschmidt . | |
| 3,948,407 | 4/1976 | Puterbaugh . | |
| 4,005,919 | 2/1977 | Hoge et al. . | |
| 4,084,347 | 4/1978 | Brown . | |
| 4,087,143 | 5/1978 | Barnard et al. . | |
| 4,107,833 | 8/1978 | Knight et al. . | |
| 4,142,766 | 3/1979 | Swerbinsky . | |
| 4,190,305 | 2/1980 | Knight et al. . | |
| 4,270,326 | 6/1981 | Hölter et al. . | |
| 4,282,687 | 8/1981 | Teleskivi . | |
| 4,536,990 | 8/1985 | Siegrist et al. . | |
| 4,585,129 | 4/1986 | Lundqvist . | |
| 4,707,401 | 11/1987 | Benford . | |
| 4,740,042 | 4/1988 | Stich et al. . | |
| 4,747,245 | 5/1988 | Lesmeister et al. . | |
| 4,779,939 | 10/1988 | Stich . | |
| 4,787,133 | 11/1988 | Lesmeister et al. . | |
| 4,878,700 | 11/1989 | Brune . | |
| 5,042,396 | 8/1991 | Shuert . | |

(List continued on next page.)

FOREIGN PATENT DOCUMENTS

| | | |
|---|---|---|
| 46-10595 | 3/1971 | Japan . |
| 59-9032 | 1/1984 | Japan . |
| 1-200184 | 1/1989 | Japan . |
| 2-040482 | 2/1990 | Japan . |

*Primary Examiner*—Laura A. Callo

[57] ABSTRACT

A refrigerator door for use in a refrigerator appliance has an outer door panel, an inner door liner, a metal reinforcing collar and a paper sheet. The collar has a generally rectangular frame that extends over a peripheral border of a central portion of the door liner. The collar also includes sidewall flanges which extend rearwardly from the frame around a corner at the peripheral border of the central liner portion and over an inner wall of a dyke sidewall of the liner. The collar provides localized support for shelves carried by the door liner and improves door rigidity. The sheet of paper extends across an opening in the middle of the frame of the collar to further improve door rigidity.

25 Claims, 4 Drawing Sheets

U.S. PATENT DOCUMENTS 5,118,174 6/1992 Benford et al. .
5,369,901 12/1994 Revlett .
5,486,045 1/1996 Dasher .
5,505,031 4/1996 Heydon .
5,573,322 11/1996 Wrobel .
5,588,731 12/1996 Schmidt et al. ..... 52/742.11 X
5,599,081 2/1997 Revlett et al. .
5,655,351 8/1997 Pohl et al. .
5,909,937 6/1999 Jenkins et al. ..... 312/405.1

REFRIGERATOR DOOR CONSTRUCTION

TECHNICAL FIELD OF THE INVENTION

The present invention relates to a refrigerator appliance and in particular a door for a refrigerator that provides local and general reinforcement for the door by using a rectangular reinforcement collar.

BACKGROUND OF THE INVENTION

For several years the trend in domestic refrigerator cabinets has been to increase the size and in particular the width of the food compartments and doors in top or bottom mount refrigerators.

Typically, the refrigerator door is constructed from an outer door panel of sheet steel material having rearwardly extending sidewalls. The door has an inner liner wall of plastic material attached to the door panel. Foam insulation is injected in the space between the outer panel and the inner liner. The foam expands and cures to thermally insulate and rigidize the door.

In order to conserve costs, the amount of steel used in the manufacture of these doors is optimized. The practice is to use a relatively thin sheet of steel for the outer panel. Often this sheet is in the order of 0.017 inches thick. Consequently, in order for the refrigerator door to maintain it's integrity and support articles or items stored on door mounted shelves, one common approach is to reinforce the door with cross braces located within the space of the door between the inner liner and the outer door panel. The metal cross braces extend from the corners of the refrigerator outer panel in an X configuration to reinforce the refrigerator door.

Another known approach to rigidize the door is to use a sheet of paper, aluminum foil or cardboard embedded in the insulation injected into the door cavity. This paper sheet is sufficiently large to cover the inside of the door and is taped to the door to prevent shifting. The sheet improves the rigidity of the door without significantly adding to the weight or cost of the door. More recently, metal sheets have been substituted for paper to improve rigidity. However, the metal sheet adds more weight to the door.

While the above described approaches in refrigerator door construction improve the rigidity of the door, these solutions do not address the need for localized support of the inner door plastic liner from the loading stresses due to large containers carried by the door shelves. Clearly, there is a need for a refrigerator door construction that locally supports the shelves carried directly by the plastic liner of the door while still optimizing the door weight and rigidity.

SUMMARY OF THE INVENTION

The present invention relates to a refrigerator appliance and, in particular, a door for a refrigerator appliance where the door includes a reinforcing collar in the form of a generally rectangular frame that includes sidewall flanges extending rearwardly of the frame over the internal door liner to provide local shelf support. The liner has a central liner portion surrounded by a cavity or recessed dyke. The collar is placed on the liner during manufacture such that the rectangular frame of the collar rests on a border region surrounding the central liner portion. The collar sidewall flanges extend into the recessed dyke cavity over corresponding first inner sidewalls of the recessed dyke. The dyke typically protrudes into the refrigerator compartment and has the first inner sidewalls which extends in a continuous fashion around the periphery of the central liner portion and form a peripheral corner with the central liner portion adjacent the border region. These first inner sidewalls of the dyke carry door shelf supports.

The frame of the reinforcing collar can be steel, other metals or plastic. The collar is like a picture frame that extends over the border region of the central liner portion. The rearwardly extending sidewall flanges of the collar extend over the inner sidewalls of the dykes. Consequently, the reinforcing collar locally supports the liner around the peripheral border region of the liner and the adjacent sidewalls of the dyke. Shelves may be mounted either by mounting fasteners that pass through the liner or are molded in the liner at the central portion or the first inner sidewalls of the dyke. Thus, the reinforcing collar frame and rearwardly extending sidewall flanges locally support the liner from stresses associated with the loading of the doors through the shelf supports. The frame like nature of the collar construction surrounds the inner walls of the dyke and border region of the central liner portion to effectively allow for distribution of the loading of the shelf supports around and over a greater area of the liner.

To complete the refrigerator door construction of the present invention, a paper or cardboard sheet, having a weight and rigidity less than that of a metal sheet, is attached to the collar frame to cover the "picture" opening in the frame. Because of the improved load distribution of the collar a lightweight paper or cardboard may be used to rigidize the larger door.

The advantages associated with the present invention are found in the use of a metal or plastic reinforcing collar frame and sidewall flanges which limit the amount of metal used within the door, locally support the liner at shelf loading areas and distributes shelf loading around the dyke sidewall. The collar also allows a sheet of paper, rather than a metal sheet, to be used to enhance the rigidity of the door. It should be understood that in the large refrigerator door construction contemplated by the present invention, the collar by itself is not sufficient to rigidize the door. Large refrigerator doors as contemplated herein are those considered to be in excess of 30 inches in width.

It should be understood that the paper may be initially secured to the outside surface of the frame of the collar by the use of tape that prevents the paper from shifting during the injection of foam into the door. However, after the foaming operation, the insulation holds the collar and paper securely in place.

The frame of the collar is preferably one piece and includes longitudinal ridges which extend along each leg of the frame where the ridges extend from the frame and into the foam. The ridges increase the surface contact area of the collar with the foam improving the collar to foam engagement.

In accordance with one aspect of the present invention there is provided a door for a refrigerator appliance including an outer door panel and an inner door liner secured to the outer door panel. The door liner comprises a central liner portion spaced from the outer door panel. The central liner portion has a peripheral border region surrounded by a recessed dyke. The recessed dyke has a first inner wall defining a peripheral corner with the peripheral border region. The first inner wall of the recessed dyke includes shelf supports. The door further includes a reinforcing collar having a generally rectangular frame and central opening. The frame extends over the peripheral border region of the central liner portion. The collar includes sidewall flanges extending rearwardly from the frame around the peripheral corner of the liner and over the first inner walls of the recessed dyke. The door includes a sheet of paper having rigidity less than the rigidity of the liner secured to the frame covering the opening. The door also includes foam insulation between the inner door liner and the outer door panel.

BRIEF DESCRIPTION OF THE DRAWINGS

For a better understanding of the nature and objects of the present invention reference may be had to the following detailed description when taken in conjunction with the accompanying diagrammatic drawings wherein.

DETAILED DESCRIPTION OF EMBODIMENTS

Figure 1:
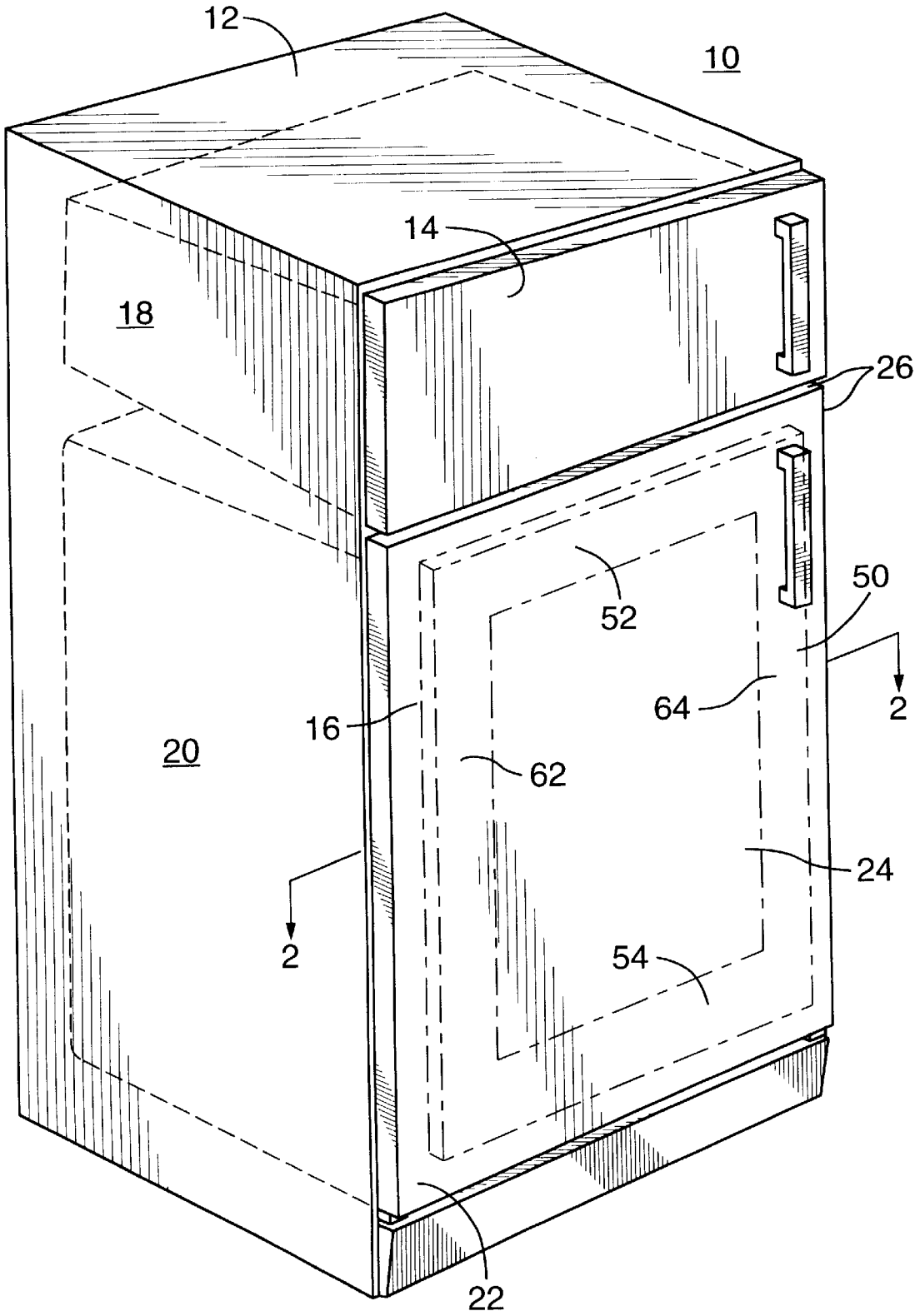
FIG. 1 is a perspective view of a top mount refrigerator appliance having top and bottom doors and showing the location of the reinforcing collar of the present invention in the lower door.

Referring to FIG. 1 there is shown a refrigerator 10 comprising a cabinet 12, a top door 14 and a lower door 16. Each of doors 14 and 16 are shown in a closed position. The top door 14 is typically adapted to close the freezer food compartment 18 and the lower door 16 typically closes the fresh food compartment 20. Of course it is understood that the position of the freezer compartment 18 relative to the fresh food compartment 20 could be reversed as in a bottom mount refrigerator. However, in accordance with the present invention, the preferred refrigerator construction is that shown having doors 14 and 16 respectively closing the upper and lower food compartments 18 and 20. The doors 14 and 16 are large size doors in excess of 30 inches in width and can be 36 inches or more in width. The reinforcement collar 50 of the present invention is illustratively shown in lower door 16.

Figure 2:
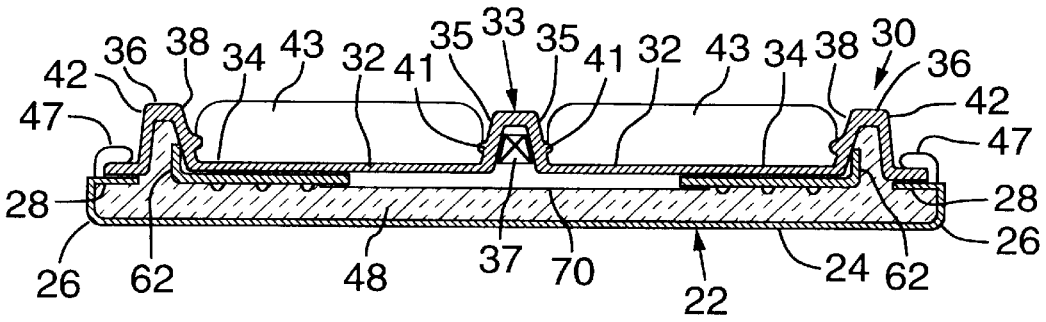
FIG. 2 is a sectional view taken at lines 2—2 of FIG. 1 showing the construction of the refrigerator door of the present invention.
Figure 3:
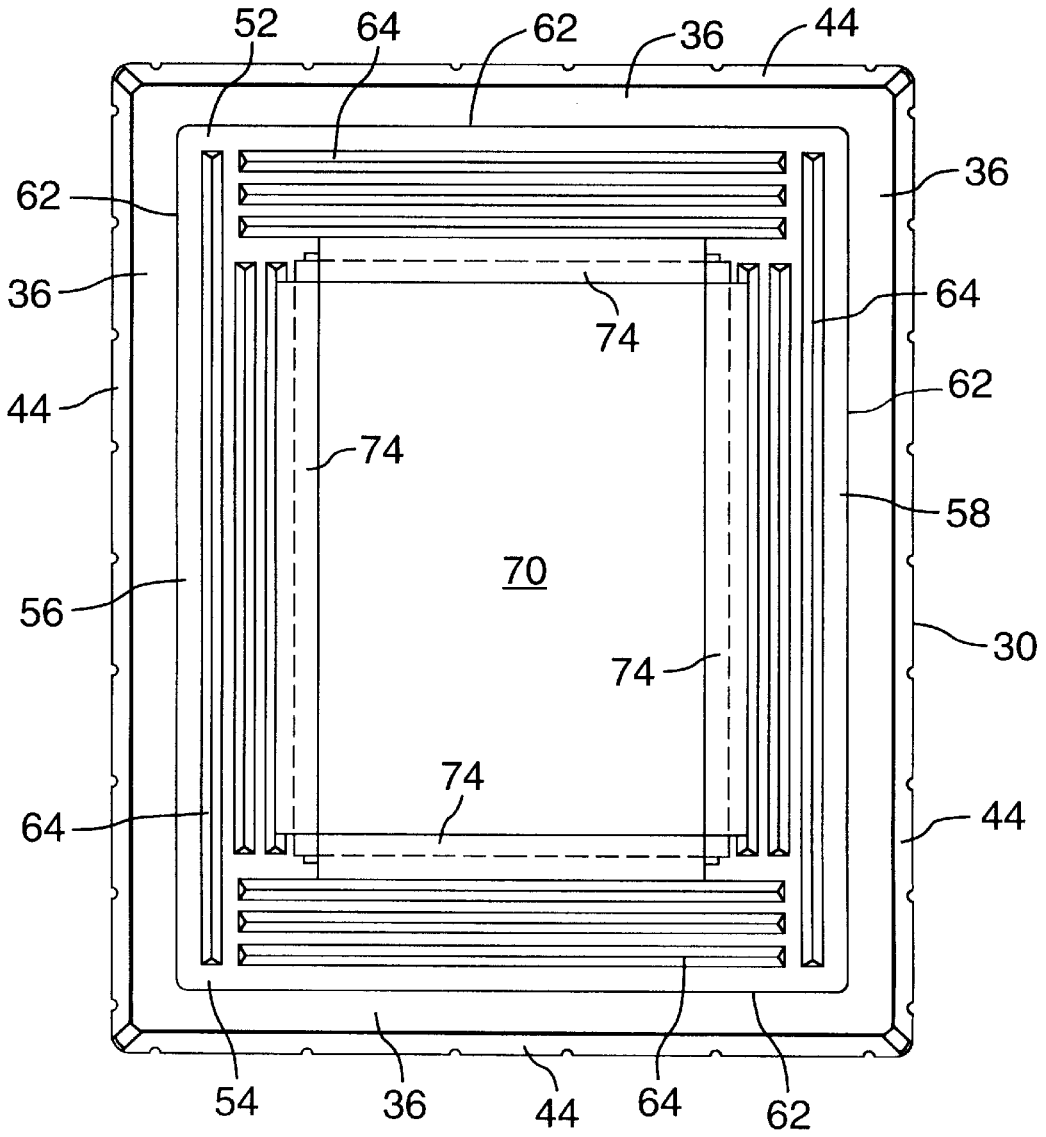
FIG. 3 is a plan view showing a reinforcing collar and paper mounted to the liner of the refrigerator door in accordance with a preferred refrigerator door construction.
Figure 4:
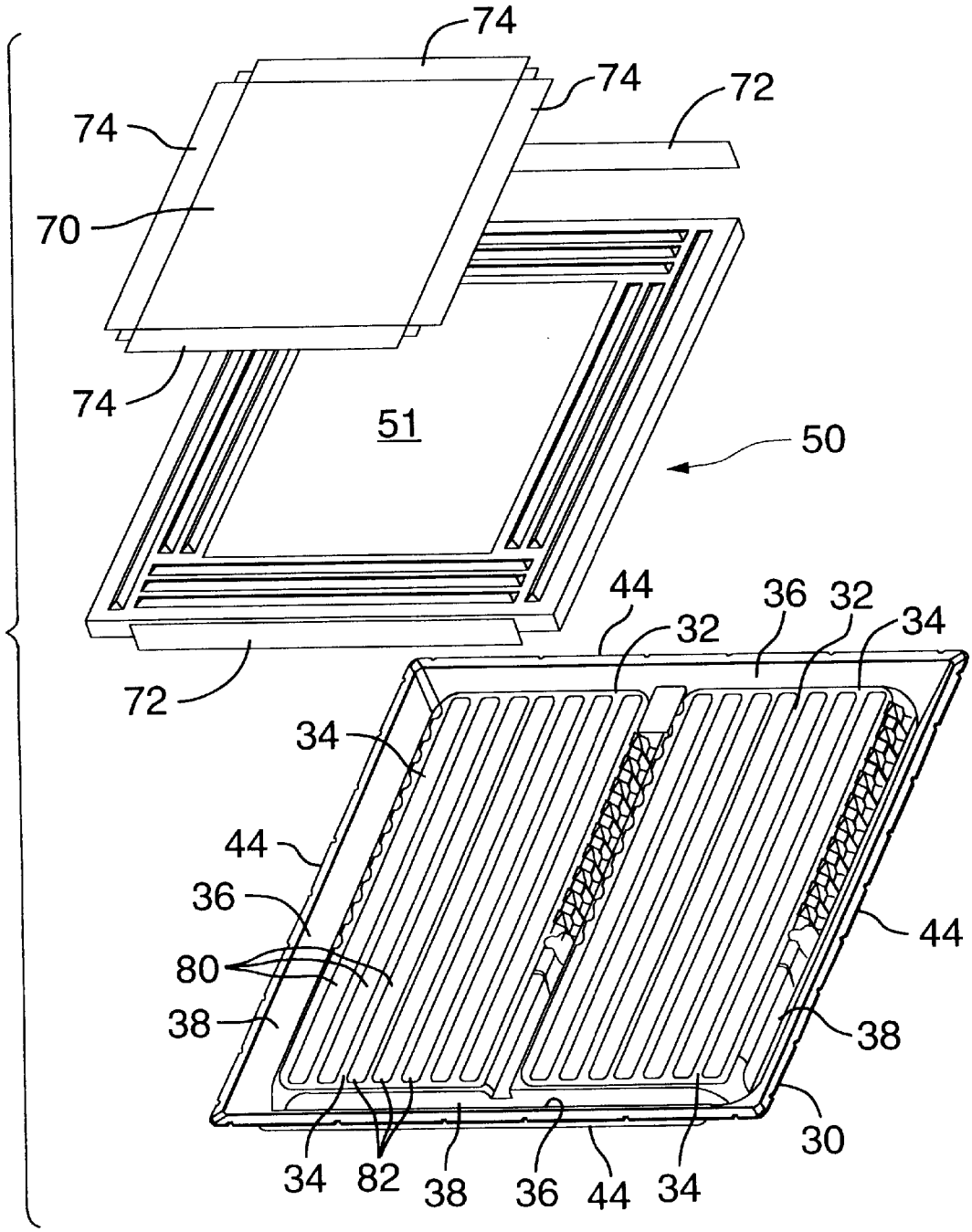
FIG. 4 is an exploded view showing the assembly of the reinforcing collar, paper, and liner of the preferred embodiment of the refrigerator door construction of the present invention prior to foaming.

In FIGS. 2 to 4, the preferred construction of door 16 is shown. Door 16 has an outer metal door panel 22. Door panel 22 has a generally flat sheet 24 with upstanding or rearwardly extending sidewalls 26. Sidewalls 26 terminate at in-turned flanges 28. Flanges 28 extend generally parallel to the flat sheet 24.

Mounted on top of the in-turned flanges 28 of the door panel 22 is a unipartite inner door liner 30 of plastic material. Liner 30 has a central liner portion 32 spaced from the generally flat sheet 24 of the outer door panel 22. The central liner portion 32 has a peripheral border region 34 which is surrounded by a recessed dyke generally shown at 36.

The recessed dyke 36 has a first inner wall 38 defining a first peripheral corner 40 with the peripheral border 34 of the central liner 32. The first inner wall 38 of the recessed dyke 36 includes integrally moulded shelf supports 41. The shelf supports 41 carry shelves 43 which in turn carry articles (not shown). The recessed dyke 36 includes; a second wall 42 extending from the first inner wall 38 to a peripheral flange 44 secured by suitable means with the in-turned flanges 28 of the outer door panel 22. Mounted on the liner flange 44 is a gasket 47 which seals the door in an airtight fashion with the refrigerator appliance 10. It should be understood that the dyke walls 36 extend in a generally rectangular fashion about the peripheral border 34 of the generally rectangular central portion 32 of the liner 30 and that the shelf supports 41 are located on the vertically extending first inner wall 38 of the dyke 36. To improve the rigidity of the liner 32, liner 32 has a series of flat elongated recesses 80 and flat rectangular ridges 82 (see FIG. 4).

In the preferred liner 30 construction, the central liner portion 32 is generally flat and includes a vertically and rearwardly extending central ridge 33 having opposed flexible sidewalls 35. Sidewalls 35 carry shelf supports 41 for supporting shelves 43. The sidewalls 35 are flexible to allow for the shelves 43 to be readily mounted on the supports 41. A reinforcing spacer 37 is located in the recessed ridge 33 behind the paper 70 to add structural localized support to the ridge 33.

Foamed insulation 48 fills the cavity or space defined between the liner 30 and the outer panel 22. The foam extends into the recesses associated with recessed dykes 36 and not into the recessed ridge 33.

Referring to FIGS. 1 through 4, the reinforcement of the refrigerator door of the present invention is described. A reinforcement collar 50 has a generally rectangular picture frame appearance having a central opening 51. The collar 50 has frame surfaces comprising shown horizontal upper frame leg surface 52, horizontal lower frame leg surface 54, and vertical side frame leg surfaces 56 and 58. The reinforcing collar 50 further includes sidewalls or rearwardly extending sidewall flanges 62 which extend rearwardly from the frame surfaces 52, 54, 56, and 58. The sidewall flanges 62 overlap in contacting relation a portion of the inner sidewall 38 of the dyke 36 to provide local support to the shelf supports 41 formed on the inner side wall 38 and to distribute shelf loading forces around the liner 30.

In the preferred construction of the collar 50 each of the legs 52, 54, 56, and 58 of the braces has a series of three ridges 64 formed from the flat surface of the collar. The ridges 64 are generally triangular in shape to engage the foam layer 48.

In FIGS. 2, 3, and 4 the rigidized reinforcement of the door is completed by the placement of a reinforcing sheet of paper 70 on the outer surface of the collar 50.

During door construction, the collar 50 is initially secured against one face of the liner 30 adjacent the peripheral border 34 of the central portion 38 of the liner by means of tape 72. Next, the paper sheet, preferably a craft paper 70, is secured by tape 74 to the outside of the collar 50 so that the paper tape covers the opening 51 located within the frame surfaces 52, 54, 56 and 58 of the collar 50. Paper 70 is spaced from the liner 32 by the thickness of the collar frame.

The use of the tape allows the paper 70 and the collar 50 to be temporarily held relative to the liner 32 with the frame portions 52, 54, 56, and 58 overlaying the peripheral border portion 34 of the central portion 38 of the liner 32 and the first inner sidewall 38. The paper 70 covers the remainder of the central portion 38 of the liner 32 when held in place by the tape and prevents foam insulation 48 from entering the space within the recess of central ridge 33 where the spacer 37 is located.

When the insulation 48 is inserted into the door, the paper 70 and reinforcement collar 50 are held in engagement within the door as shown in FIG. 2. Also, the sidewalls 62 of the reinforcement collar 50 are shown engaging a portion of the inner sidewalls 38 of the dykes 36 adjacent shelf supports 41.

The paper 70 minimizes the amount of weight added to the door and improves the structural rigidity to the door. The reinforcement collar 50, which is preferably a metal sheet material, locally supports to the liner 32 adjacent the border portion 34 and the inside dyke wall 38 of the liner 32 where most of the localized stresses associated with loading of shelves 43 on supports 41 occurs.

Figure 5A:
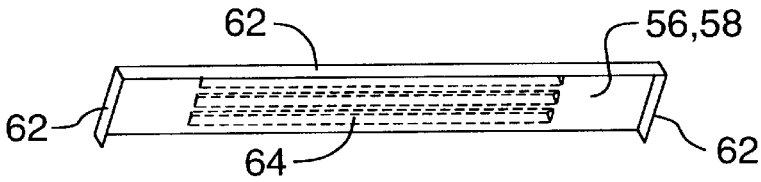
FIGS. 5(*a*) and 5(*b*) show respectively vertical and horizontal braces used in the construction of an alternate embodiment for the collar of the present invention; and, FIG. 6 is a view of the braces of FIGS. 5(*a*) and 5(*b*) constructed in the formation of the collar when viewing the collar from the liner.
Figure 5B:
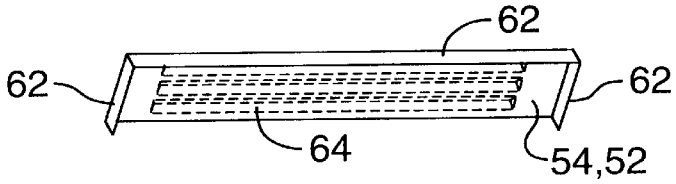
Figure 6:
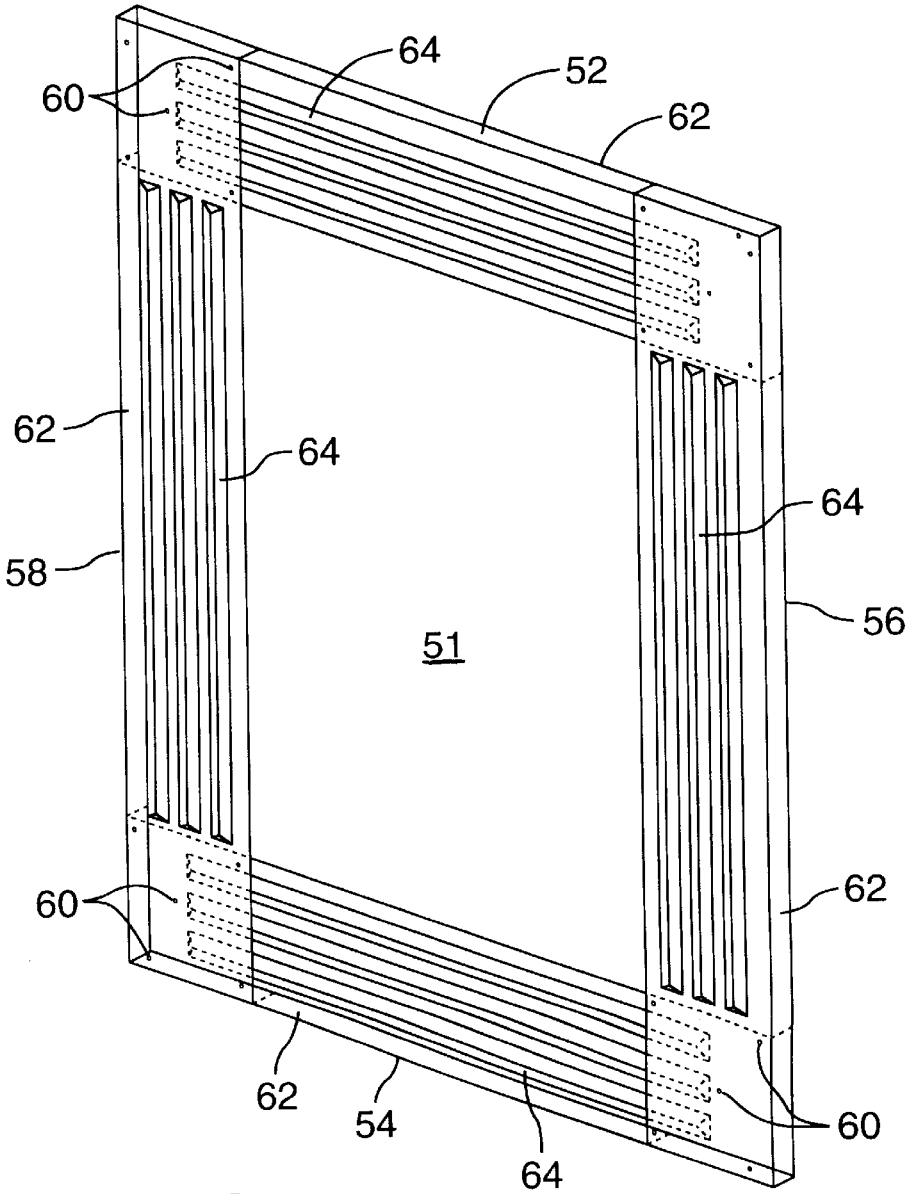

An alternative construction for the collar 50 is shown in FIGS. 5*a*, 5*b* and 6. The side frame surfaces 56 and 58 are braces which are mounted together in overlapping fashion with horizontal braces 52 and 54 overlying the vertical braces 56 and 58. The holding braces are held together by crimps 60 as shown in FIG. 6 prior to the braces being placed on the liner 32 during manufacture.

Each of the horizontal and vertical braces includes sidewalls 62 such that when the horizontal braces are placed in overlapping fashion over the vertical braces, sidewalls 62 overlap. Accordingly, in the construction of the collar 50 the horizontal braces 52, 54 are raised from the central liner surface 70 by the material thickness above the vertical braces 56, 58.

As is apparent from the forgoing disclosure, various other embodiments and alterations and modifications which may differ from the embodiments disclosed may be readily apparent to one skilled in the art. It should be understood that the scope of the patent shall be defined by the claims and those embodiments which come within the scope of the claims that follow.

What is claimed is:

1. A door for a refrigerator appliance comprising:

an outer door panel and an inner door liner secured to the outer door panel, the door liner comprising a central liner portion spaced from the outer door panel, the central liner portion having a peripheral border region surrounded by a recessed dyke, the recessed dyke having a first inner wall defining a peripheral corner with the peripheral border region, the first inner wall of the recessed dyke including shelf supports;

a reinforcing collar having a generally rectangular frame and central opening, the frame extending over the peripheral border region of the central liner portion, the collar including side wall flanges extending rearwardly from the frame around the peripheral corner of the liner and over the first inner walls of the recessed dyke;

a sheet of paper having a rigidity less than the rigidity of the liner secured to the frame and covering the central opening; and foam insulation between the inner door liner and the outer door panel.

2. The door for a refrigerator appliance as claimed in claim 1 wherein the sheet of paper is secured to an outside surface of the frame of said collar.

3. The door for a refrigerator appliance as claimed in claim 1 wherein the frame of said collar includes longitudinal ridges extending along each leg of the frame, and the ridges having a surface contact area that extends into the foam insulation.

4. The door for a refrigerator appliance as claimed in claim 3 wherein the collar is held firmly in place against the liner by the foam insulation.

5. The door for a refrigerator appliance as claimed in claim 1 wherein the shelf supports are integrally molded into the first inner walls of the recessed dyke.

6. The door for a refrigerator appliance as claimed in claim 5 wherein the door liner includes a central vertically and rearwardly extending ridge having opposing flexible sidewalls that include additional shelf supports.

7. The door for a refrigerator appliance as claimed in claim 6 wherein the central door ridge includes spacer for locally supporting the opposing flexible sidewalls of the ridge.

8. A door for a refrigerator appliance comprising:

an outer metal door panel having a generally flat metal sheet with rearwardly extending side walls and in-turned flanges extending generally parallel to the flat sheet;

an unipartite plastic inner door liner comprising a central liner portion spaced from the outer door panel, the central liner portion having a peripheral border region surrounded by a recessed dyke, the recessed dyke having a first inner wall defining a peripheral corner with the peripheral border region, the first inner wall of the recessed dyke including shelf supports, the recessed dyke including a second wall extending from the first inner wall to a peripheral flange secured with the in-turned flanges of the outer door panel;

a reinforcing collar having a generally rectangular frame and central opening, the frame extending over and supporting the peripheral border region of the central liner portion, the collar including side wall flanges extending rearwardly from the frame around the peripheral corner and in contact over the first inner walls of the recessed dyke;

a sheet of paper having a rigidity less than the rigidity of the liner secured to the frame and covering the central opening; and foam insulation between the inner door liner and the outer door panel.

9. The door for a refrigerator appliance as claimed in claim 8 wherein the foam insulation is located within the recessed dyke.

10. The door for a refrigerator appliance as claimed in claim 8 wherein the sheet of paper is secured to an outside surface of the frame of said collar.

11. The door for a refrigerator appliance as claimed in claim 10 wherein sheet of paper is secured by tape to the outside surface of the frame of said collar.

12. The door for a refrigerator appliance as claimed in claim 8 wherein the frame of said collar includes longitudinal ridges extending along each leg of the frame, and the ridges having surface contact areas extending into the foam insulation.

13. The door for a refrigerator appliance as claimed in claim 8 wherein the central liner portion comprises a generally rectangular area having a series of vertical extending flat ribs to further strengthen the liner.

14. The door for a refrigerator appliance as claimed in claim 8 wherein the collar is taped to the liner for holding the collar relative to the liner.

15. The door for a refrigerator appliance as claimed in claim 8 wherein the collar is held firmly in place against the liner by the foam insulation.

16. The door for a refrigerator appliance as claimed in claim 8 wherein the reinforcing collar comprises two vertical extending braces and two horizontal extending braces.

17. The door for a refrigerator appliance as claimed in claim 16 wherein each of the braces includes longitudinally extending ridges, and the ridges extending into the foam to increase the surface area in contact with the foam.

18. The door for a refrigerator appliance as claimed in claim 17 wherein the vertical braces are placed in contact with the central liner portion along the peripheral border region.

19. The door for a refrigerator appliance as claimed in claim 17 wherein the horizontal braces overlay upper and lower ends of the vertical braces and are spaced from the central liner portion, the vertical braces.

20. The door for a refrigerator appliance as claimed in claim 8 further including a door sealing gasket extending over the peripheral flange of the inner door liner.

21. The door for a refrigerator appliance as claimed in claim 8 wherein the shelf supports are integrally molded into the first inner walls of the recessed dyke.

22. The door for a refrigerator appliance as claimed in claim 21 wherein the door liner includes a central vertically and rearwardly extending ridge having opposing flexible sidewalls that include additional shelf supports.

23. The door for a refrigerator appliance as claimed in claim 22 wherein the central door ridge includes spacer for locally supporting the opposing flexible sidewalls of the ridge.

24. The door for a refrigerator appliance as claimed in claim 8 wherein the collar is metal.

25. The door for a refrigerator appliance as claimed in claim 8 wherein the door has a width in excess of 30 inches.

* * * * *